United States Patent [19]

Hertel et al.

[11] Patent Number: 4,828,195

[45] Date of Patent: May 9, 1989

[54] SURFACE WINDER AND METHOD

[75] Inventors: James E. Hertel; Gerry Buxton, both of Green Bay, Wis.

[73] Assignee: Paper Converting Machine Company, Green Bay, Wis.

[21] Appl. No.: 162,169

[22] Filed: Feb. 29, 1988

[51] Int. Cl.[4] ..... B65H 17/12

[52] U.S. Cl. ..... 242/66; 242/DIG. 3

[58] Field of Search ..... 242/56 R, 66, 65, DIG. 3

[56] References Cited

U.S. PATENT DOCUMENTS

| | | | |
|---|---|---|---|
| 3,720,381 | 3/1973 | Rehme . | |
| 3,889,892 | 6/1975 | Melead | 242/65 X |
| 4,223,850 | 9/1980 | Alexander, III . | |
| 4,245,796 | 1/1981 | Eglinton | 242/66 |
| 4,256,269 | 3/1981 | Feighery et al. | 242/66 |
| 4,327,877 | 5/1982 | Perini | 242/66 |
| 4,516,735 | 5/1985 | Snygg . | |
| 4,583,698 | 4/1986 | Nistri . | |
| 4,598,877 | 7/1986 | Oinonen . | |
| 4,601,441 | 7/1986 | Oinonen et al. | 242/66 X |
| 4,715,552 | 12/1987 | Matsumoto . | |

*Primary Examiner*—Stuart S. Levy
*Assistant Examiner*—Steven M. duBois
*Attorney, Agent, or Firm*—Tilton, Fallon, Lungmus & Chestnut

[57] ABSTRACT

A surface winder and method in which a stationary upper winding roll, a lower movable winding roll and a rider roll form a three roll cradle, the lower winding roll being reciprocated to control the position of a partially wound core until the rider roll returns to cradle position after permitting passage of a previously wound log and in which a compensator roll is provided to control web slack after cutoff and transfer.

14 Claims, 3 Drawing Sheets

SURFACE WINDER AND METHOD

BACKGROUND AND SUMMARY OF INVENTION

This invention relates to a surface winder and method and, more particularly, to winding of flexible web material into rolls/logs such as are commonly used in kitchen toweling and toilet tissue.

Surface winding, as well as center winding, has been practiced for developing convolute rolls/logs. A discussion is found in co-owned U.S. Pat. No. 4,723,724. There, surface winding was achieved by belts which were difficult to handle and expensive. Another approach to surface winding is seen in U.S. Pat. No. 4,583,698 which makes use of cradle rolls.

According to the instant invention, the lower winding roll of the cradle is reciprocated and is advantageous over the '698 patent because there is more time for rider roll action and therefore the potential for more winding cycles per minute. Further, the roll motion is slow, gentle and simple compared to the changing of roll surface speed of the '698 patent. Still further, the surface winder of the invention avoids the harder wind about the core characteristic of the '698 patent.

Another principal feature of the invention is the means for web control at cutoff/transfer. This provides for web gathering and improves transfer and initial wind quality. Other objects and advantages of the invention may be seen in the details of the ensuing specification.

The invention is described in conjunction with the accompanying drawing, in which FIG. 1 is a fragmentary side elevational view of the portion of the machine featuring the cradle rolls employed for the winding cycle;

DETAILED DESCRIPTION

Figure 1:
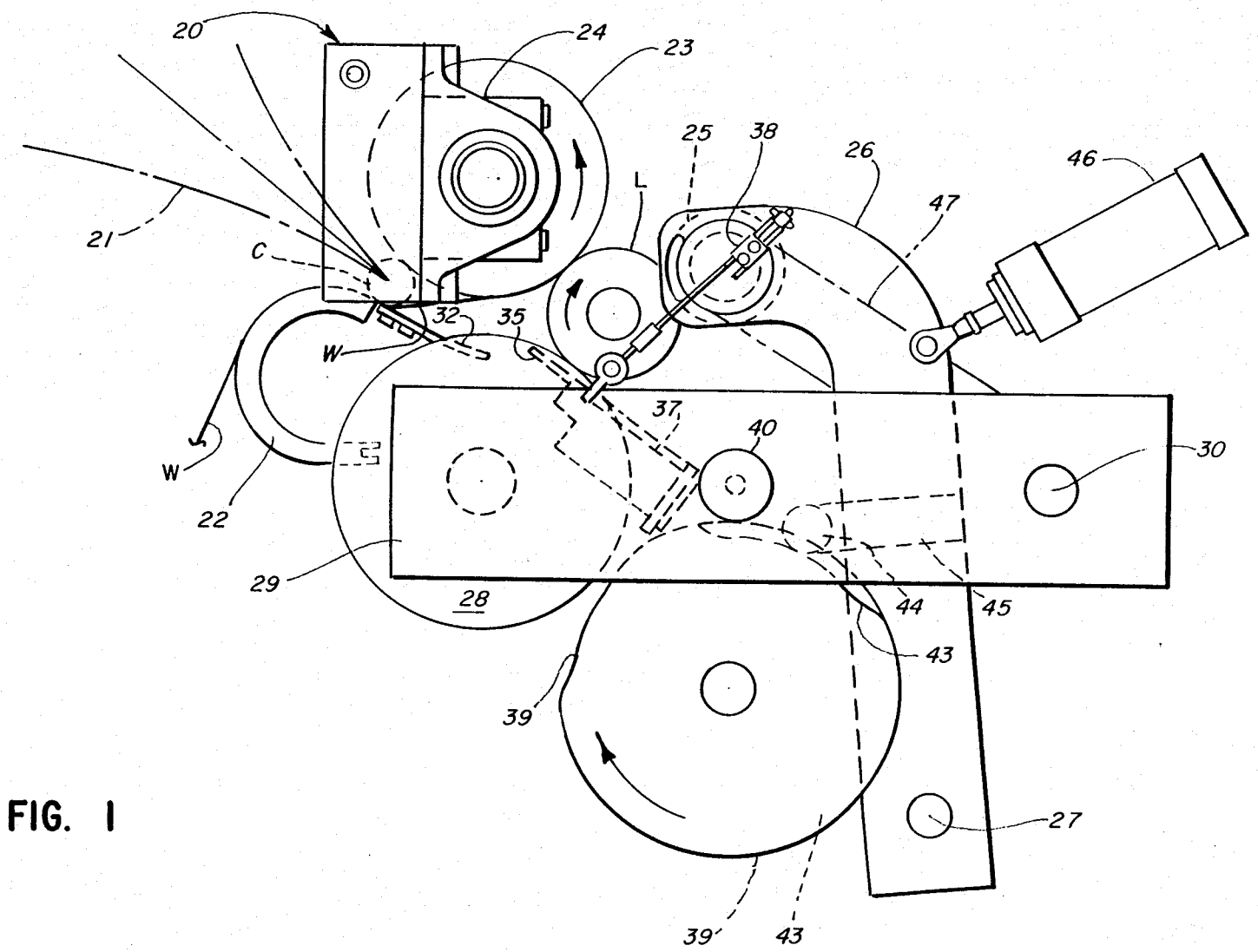
Figure 2:
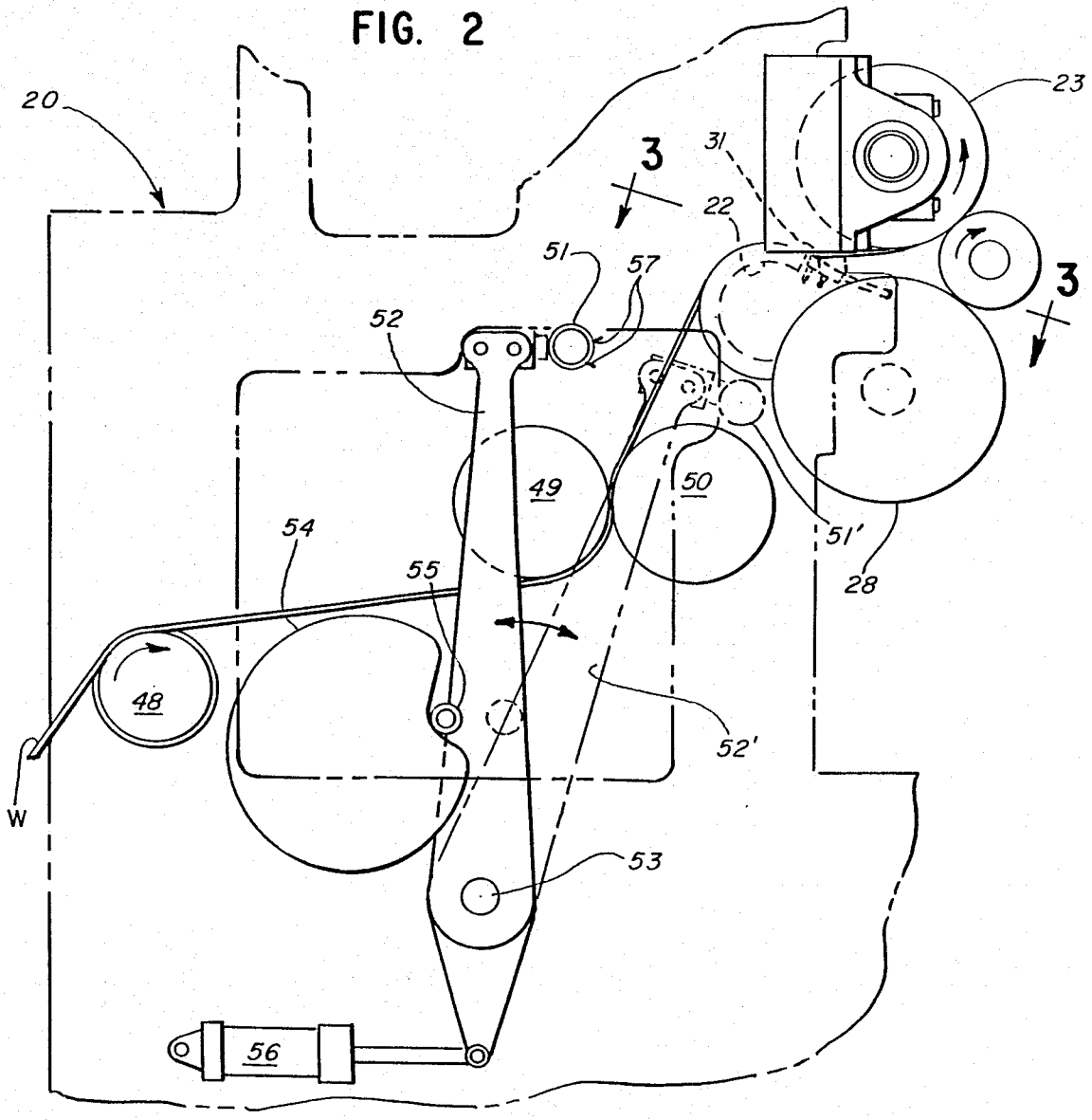
FIG. 2 is another fragmentary side elevational view of the inventive winder not only embodying the cradle rolls of FIG. 1 but also showing additional machine elements, particularly those involved in the gathering of the web incident to web transfer.

In the illustration given and with reference first to FIGS. 1 and 2, the symbol W designates a web such as paper which is arranged for advance through a predetermined path within the frame 20 of the winder. As can be appreciated from FIG. 2, the frame is of the well known construction including essentially side frames **20*a* and 20*b* which are employed to support the various rolls and other mechanism. The spaced-apart side frames 20*a*, 20*b*** define the side edges of the predetermined path along which the web to be wound is advanced.

Shown schematically in the upper left hand portion of FIG. 1 is a hypocycloidal core inserting mechanism 21, the details of which can be seen in the above identified U.S. Pat. No. 4,723,724.

FIG. 1 illustrates the orientation of the web at the end of one winding cycle and the beginning of the next cycle. The web W is seen to pass over a stationary turning bar 22 and into contact with a core C just prior to cutoff/transfer. The web continues as at W′ toward the upper and stationary winding roll 23 for travel therewith. Roll 23 is rotatably mounted in the frame 20 as at 24. The web W is finally seen to be in the process of being wound around a log L which is near the completion of its winding cycle. Here it will be appreciated that the term "log" is commonly used in the paper converting art to designate an elongated wound roll but that the terms wound log and wound roll are used interchangeably by those skilled in the art. Currently, the practice is to have a fairly wide web, 100″ or more, wound around a similar length core and then transversely sawed into retail size rolls. In the past, rolls also have been generated by slitting the web just prior to being wound on the core.

Still referring to the upper portion of FIG. 1, it will be noted that the log L is contacted by a rider roll 25 carried by a pair of pivotally mounted arms 26. The arms 26 are pivotally mounted on the frame as at 27.

The log L is also contacted by the lower, movable winding roll 28 which together with rolls 23 and 25 form a three-roll cradle. The lower winding roll 28 is carried by pivot arms 29 which pivot around axis 30.

OPERATION GENERALLY

Figure 3:
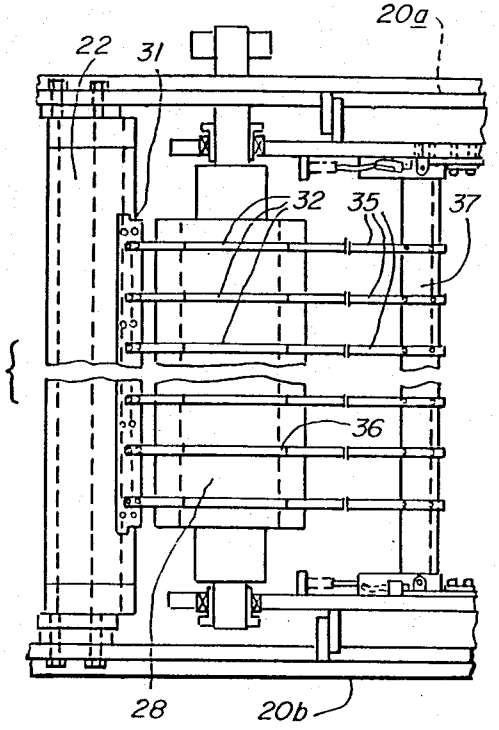
FIG. 3 is a fragmentary top plan view of the winder portion of FIG. 2 such as would be seen essentially along the segmented line 3—3 of FIG. 2.
Figure 4:
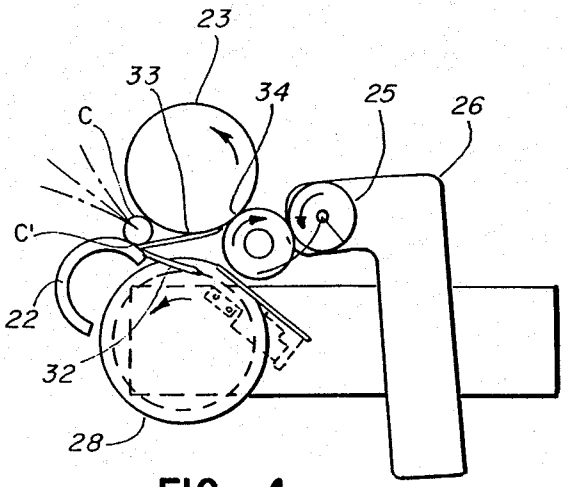
FIGS. 4–9 are schematic side elevational views of the cradle rolls shown at different stages of the winding cycle.

Reference is hereby made to the third drawing sheet which include FIGS. 4–9 showing the various stages of the winding cycle. FIG. 4, for example, illustrates the point of incipient cutoff/transfer and corresponds to the showing in FIG. 1. This is the moment when a log L has been completely wound and a new core C has been inserted into the space between the stationary winding roll 23 and the stationary turning bar 22. More particularly, the stationary turning bar 22 carries a web breaker bar 31—see FIG. 3. In addition, the stationary turning bar 22 (through the web breaker bar 31) carries stationary fingers 32 and the assembly of elements 22, 31 and 32 can be considered a stationary finger means.

In FIG. 4, the core C is positioned between the stationary winding roll 23 and the web breaker bar 31. The core insertion is timed relative to the transverse perforations in the web so that a single line of perforation is located in the general vicinity of the point 33, i.e., between the point C′ where the core C pinches the web against the breaker bar 31 and the point 34 where the log L being wound contacts the stationary winding roll 23. This single line of perforation is then broken. Also the core C begins to rotate clockwise, rolling on the web breaker bar 31 and onto the stationary fingers 32—being driven by the stationary winding roll 23.

Prior to insertion through the previously mentioned hypocycloidal inserting mechanism, the core C has been equipped with a stripe or line of transfer glue. As the core C rolls onto and over the now stationary portion of web W between the pinch point C′ and the broken line of perforation, the transfer glue is pressed firmly against the web W effecting transfer of the web W to the core C to begin a new winding cycle.

Figure 5:
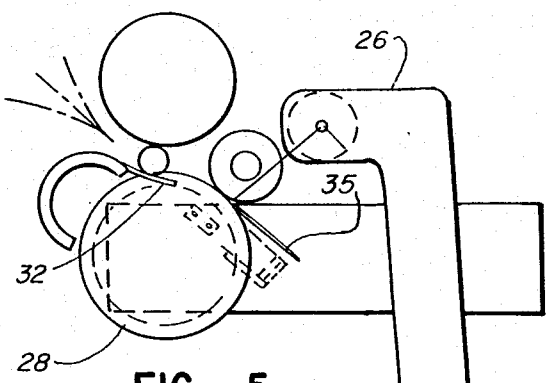

At this point in time, the rider roll pivot arms 26 pivot clockwise, moving the rider roll 25 away from the finished log L and also move discharge fingers 35 into contact with log L—see FIG. 5.

The discharge fingers 35, like the stationary fingers 32 are received within circumferential grooves 36 (see FIG. 3)in the lower movable winding roll 28. The discharge fingers 35 are carried by a pivot shaft 37 which is connected by means of a lost-motion connection 38 to the rider roll pivot arms 26.

Figure 6:
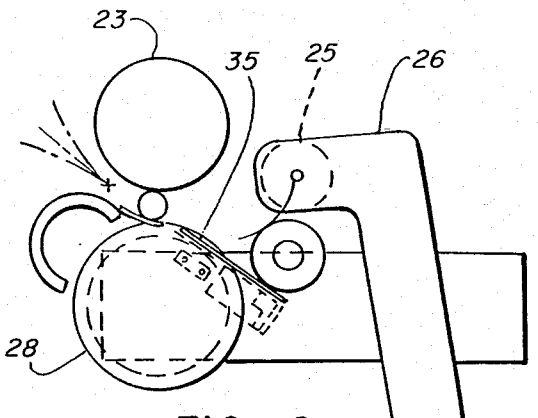
Figure 7:
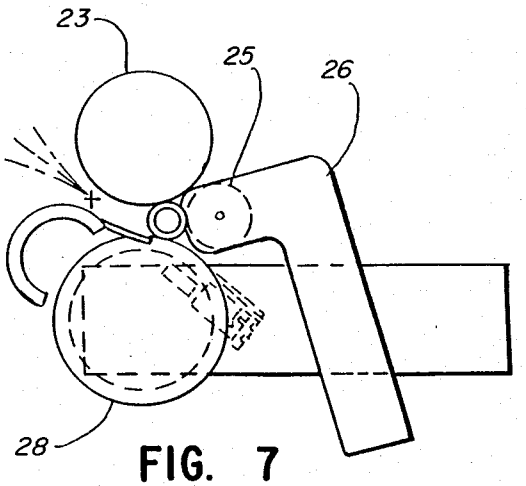

As can be seen from FIG. 6, the action of the rider roll 25 and discharge fingers 35 removes the log L from the winding area quickly and thereafter permits the rider roll pivot arms 26 to pivot counterclockwise to return the rider roll 25 into contact with the new log being wound. This occurs advantageously after from about 5% to about 15% of the winding cycle. Meanwhile, the core C progresses rapidly to the valley formed by the stationary fingers 32, the stationary winding roll 23 and the lower movable winding roll 28—as can be seen in FIG. 6. The new log being wound stays in this valley because (a) the nip or spacing between the rolls 23 and 28 is less than the partially wound log diameter and (b) the stationary fingers 32 create a surface which urges the partially wound log toward the nip between the rolls 23 and 28.

The nip between the rolls 23 and 28 increases, being controlled by cams 39 via cam followers 40 carried by the arms 29 (see FIG. 1). The arms 29 with the cams 39 and followers 40 thus constitute means for reciprocating the roll 28. Gravity holds the followers 40 in operative contact with the cams 39. The lower winding roll 28 is driven at a constant surface speed equal to or slightly slower than the surface speed of the stationary winding roll 23.

Figure 8:
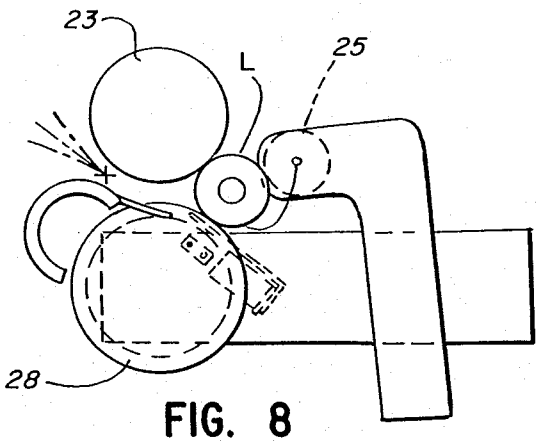
Figure 9:
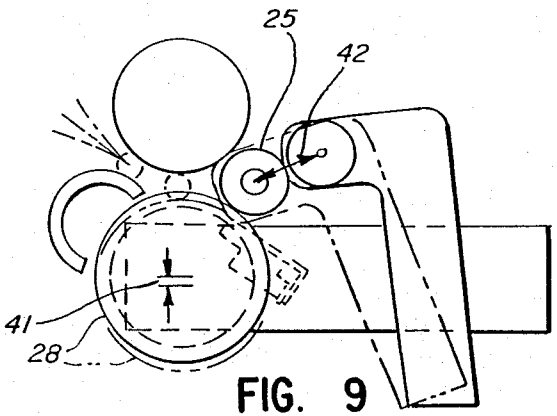

The action provided by the cams 39 causes the roll 28 to move slowly away from the roll 23 as the diameter of the partially wound log increases. Preferably, the motion of the roll 28 is carefully controlled via the contour of the cams 39 to keep the winding of the new log in the valley and then let the log pass slowly through the nip between the rolls 23 and 28 into contact with the rider roll 25. Once 3-roll winding has been established, the cams 39 slowly return the lower winding roll 28 to its transfer position, i.e., closer to roll 23. FIG. 8 shows the position of the log L at the completion of the wind, i.e., 100%. FIG. 9 shows at 41 the amount of movement of the lower winding roll 28 and also the amount of movement 42 of the rider roll 25.

The movement of the rider roll arms 26 (referring to FIG. 1) is controlled by cams 43 via cam followers 44 carried by the arms 26 via brackets 45. Air cylinders 46 hold the cam followers 44 in operative contact with the cams 43. Thus, the arms 26 with the cams 43 and followers 44 provide means for pivoting the idler roll away from the log L.

The rider roll 25 is driven by a belt and pulley arrangement 47 (see the upper central part of FIG. 1) at a constant speed approximately equal to the surface speed of the stationary winding roll 23.

WEB CONTROL AT CUTOFF/TRANSFER

Referring now to FIG. 2, the web W of perforated paper enters into surface winding by first passing over and partially around a web spreader roll 48. The web then passes between and partially around draw rolls 49 and 50 which constitute part of the means for advancing the web W along a predetermined path in the frame 20. The rolls 49, 50 feed the web into the winding area and isolate winding action from upstream operation such as perforating, embossing, printing and unwinding. Thereafter the web passes around the stationary turning bar 22 which is also illustrated in FIG. 1. The ensuing description is directed toward what happens in the practice of the invention prior to the web engaging the web breaker bar 31

At the moment of cutoff/transfer when the new core C pinches the web W against the web breaker bar 31, the web W stops and there is no force or motion advancing the web which is being fed to the winder via the driven draw rolls 49, 50. After the core has been rotated about ¾ of a revolution, it begins again to take up web as the new log begins to be wound. This momentary stopping of web motion at the web breaker bar 31 creates about 3" to 4½" of slack web between the draw rolls 49, 50 and the new core C. The exact amount of slack created varies with core diameter, web characteristics and winder adjustments. It is necessary to control this slack immediately after cutoff/transfer and prevent it from accumulating from cycle to cycle.

In order to control this slack there is a compensator bar 51 which quickly gathers the slack web W in the space between the stationary turning bar 22 and the right hand draw roll 50, and then releases this gathered web to the log being wound during the remainder of the winding cycle. Thus, at transfer/cutoff the web W lies on a straight line between the web breaker bar 22 and the draw roll 50 and immediately after transfer, the web W is gathered by the compensator bar 51 into the space between bar 22 and roll 50 as illustrated by the position 51'.

To provide gathering means, the compensator bar 51 is mounted on pivot arms 52 which pivot around axis 53 to the dashed line position 52'. The motion of the arms 52 is controlled by compensator cams 54 via cam followers 55. Air cylinders 56 hold the cam followers 55 in operative contact with the cams 54. The compensator bar 51 is a hollow shaft in the illustrated embodiment and supplied with air which flows out of the bar 51 via small holes to provide jets 57 to lubricate the flow of web W over the bar 51 in the gathered mode.

The compensator bar 51 actually leaves its standby position prior to cutoff/transfer. Standby position is illustrated at 51 in FIG. 2. The purpose of this action is to provide the space and time to accelerate bar 51 before it contacts the web W at the moment of cutoff/-transfer so that the initial rate of gathering slack is maximized within practical limits of machine design. Thus the slack is gathered very quickly and released to the winding process over the remainder of the winding cycle.

This gathering and releasing of slack means that the stationary winding roll surface speed (roll 23) must be sufficiently greater than the surface speed of draw rolls 49, 50 to take up all the slack during each cycle and prevent cycle-to-cycle accumulation. It is possible but unlikely, that a web W may be so elastic that the surface speed of roll 23 need not be greater than the surface speed of the rolls 49, 50.

While in the foregoing specification a detailed description of an embodiment of the invention has been set down for the purpose of illustration, many variations in the details hereingiven may be made by those skilled in the art without departing from the spirit and scope of the invention.

We claim:

1. A surface winder for developing a web log comprising a frame, means operatively associated with said frame for advancing a web along a predetermined path in said frame, a stationary winding roll rotatably mounted in said frame on one side of said path, stationary finger means mounted on said frame on the other side of said path adjacent said stationary winding roll and spaced therefrom a distance sufficient to receive a core to be wound in said path, said stationary winding roll cooperating with said stationary finger means to rotate said core, a movable winding roll rotatably mounted in said frame on the other side of said path and downstream in the direction of web advance from said stationary finger means and forming a nip with said stationary winding roll, means on said frame for reciprocating said movable winding roll relative to said stationary winding roll from a first position precluding passage of a partially-wound log through said nip to a second position permitting passage of said partially wound log through said nip.

2. The surface winder of claim 1 in which a rider roll is pivotally mounted on said frame for engagement with said partially-wound log after the same has passed through said nip.

3. The surface winder of claim 2 in which means are provided for pivoting said rider roll away from a log at the end of a winding cycle to permit removal of a completely wound log from contact with said stationary winding roll and for pivoting said rider roll toward said stationary winding roll after said removal, said reciprocating means being coordinated with said pivoting means to move said movable winding roll away from aid stationary winding roll to enlarge said nip to permit passage of said partially wound log therethrough when said rider roll is moving toward said stationary winding roll to develop a three-roll cradle for said partially wound log downstream of said nip.

4. The surface winder of claim 2 in which said movable winding roll is equipped with circumferential grooves for receipt of said stationary finger means, and discharge finger means are operatively associated with said rider roll also received in said circumferential grooves.

5. The surface winder of claim 1 in which draw roll means are mounted on said frame in said web path upstream of said stationary finger means, and gathering means on said frame between said draw roll means and stationary finger means for taking up web slack upon cutoff and transfer of said web to a core and gradually releasing the gathered web during the ensuing winding cycle.

6. The surface winder of claim 5 in which said gathering means includes a pivotally mounted compensator bar, and cam means operatively associated with said compensator bar for initiating compensator bar movement toward said web shortly prior to cutoff and transfer.

7. The surface winder of claim 6 in which said compensator bar is equipped with air delivery means for lubricating web movement over said compensator bar when said web is in its gathered mode.

8. A surface winder for developing a web log comprising a frame, means operatively associated with said frame for advancing a web along a predetermined path in said frame, means on said frame in said path for receiving a glue-equipped core to be wound and for cutting off said web and transferring the leading edge portion of the cutoff web to a core, draw roll means on said frame in said path upstream of said receiving means, and gathering means on said frame between said draw roll means and receiving means for taking up web slack beginning to develop upon cutoff and transfer of said web to said core and gradually releasing the gathered web during the ensuing winding cycle, said receiving means including stationary plate means and winding roll means spaced on opposite sides of said path a distance apart sufficient to receive said core, said stationary winding roll means cooperating with said stationary plate means to rotate said core, said gathering means including a compensator bar pivotally mounted on said frame on one side of said path.

9. A method of winding a web on a core to develop a wound log comprising advancing a web along a predetermined path, positioning a glue-equipped core in contact with said web and substantially simultaneously therewith cutting off said web, winding the web upstream of the cutoff on said core between spaced apart stationary finger means and a first winding roll positioned on opposite sides of said path, advancing said core during winding thereof along said path toward a valley defined by said first winding roll on one side of said path and said stationary finger means and a second winding roll on the other side of said path, while said core is moving toward said valley removing a previously wound core from contact with said first and second winding rolls, and thereafter during winding moving said second winding roll away from said first winding roll to increase the spacing between said winding rolls to permit a partially wound log to pass between said winding rolls.

10. The method of claim 9 in which a rider roll is movably positioned adjacent said path downstream of said pair of winding rolls, and moving said rider roll into contact with said partially wound log when the same has passed between said winding roll means.

11. The method of claim 10, in which said partially wound log is passed through the space between said winding rolls after from about 5% to about 15% of said log is wound.

12. The method of claim 10 in which when said log is about 100% wound moving said rider roll out of contact with said log and substantially simultaneously therewith providing finger ramp means for gravity removal of said log from contact with said pair of winding rolls.

13. The method of claim 9 in which at web cutoff slack begins to develop in said web upstream of cutoff and gathering said slack and gradually releasing the same during the winding cycle.

14. The method of claim 13 including providing a movable compensator bar bearing upon one side of said web for gathering said web, said compensator bar shortly prior to cutoff being spaced from said web and moved toward said web prior to cutoff.

* * * * *